US010971070B2

(12) United States Patent
Liu et al.

(10) Patent No.: US 10,971,070 B2
(45) Date of Patent: Apr. 6, 2021

(54) DRIVER CIRCUIT AND ITS WORKING METHOD AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Lianbin Liu, Beijing (CN); Hengzhen Liang, Beijing (CN); Chuanyan Lan, Beijing (CN); Xu Lu, Beijing (CN); Hui Wen, Beijing (CN); Shihao Wang, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/673,071

(22) Filed: Nov. 4, 2019

(65) Prior Publication Data

US 2020/0219449 A1 Jul. 9, 2020

(30) Foreign Application Priority Data

Jan. 4, 2019 (CN) ..... 201910007225.2

(51) Int. Cl.
*G09G 3/3258* (2016.01)
*G09G 3/00* (2006.01)

(52) U.S. Cl.
CPC ..... *G09G 3/3258* (2013.01); *G09G 3/006* (2013.01)

(58) Field of Classification Search
CPC ..... G09G 3/3258; G09G 3/006; G09G 2300/0426; G09G 2330/12; G02F 1/1309; G02F 2001/136254
See application file for complete search history.

(56) References Cited

U.S. PATENT DOCUMENTS 9,964,819 B2 * 5/2018 Huang ..... G02F 1/136204
2001/0020988 A1 * 9/2001 Ohgiichi ..... G02F 1/13452 349/54

(Continued)

FOREIGN PATENT DOCUMENTS

CN 104280908 A 1/2015
CN 105096781 A 11/2015

(Continued)

OTHER PUBLICATIONS

First Office Action for Chinese Application No. 201910007225.2, dated Dec. 25, 2019, 11 Pages.

*Primary Examiner* — Tom V Sheng
(74) *Attorney, Agent, or Firm* — Brooks Kushman P.C.

(57) ABSTRACT

The present disclosure provides a driver circuit and its working method and a display device. The driver circuit includes: a driver chip coupled with a plurality of signal lines; a plurality of signal line leads that are corresponding to the plurality of signal lines in a one-to-one manner; and a plurality of short-circuit shielding circuits that are corresponding to the plurality of signal line leads in a one-to-one manner. Each of the plurality of short-circuit shielding circuits is coupled between corresponding one of the plurality of signal line leads and corresponding one of the plurality of signal lines, and is configured to turn on or off a connection between the corresponding one of the plurality of signal line leads and the corresponding one of the plurality of signal lines.

15 Claims, 6 Drawing Sheets

(56) References Cited

U.S. PATENT DOCUMENTS

| | | | | |
|---|---|---|---|---|
| 2002/0145440 | A1 | 10/2002 | Ohya et al. | |
| 2008/0117345 | A1* | 5/2008 | Ishii | G02F 1/136204 349/40 |
| 2009/0244429 | A1* | 10/2009 | Chung | G02F 1/13458 349/56 |
| 2014/0176844 | A1* | 6/2014 | Yanagisawa | G09G 3/006 349/43 |
| 2016/0246145 | A1 | 8/2016 | Du et al. | |
| 2018/0069030 | A1* | 3/2018 | Zhang | G01R 31/26 |
| 2018/0197445 | A1 | 7/2018 | Li et al. | |
| 2018/0197456 | A1* | 7/2018 | Xing | H01L 27/1214 |
| 2019/0025619 | A1* | 1/2019 | Lv | G02F 1/136286 |
| 2019/0051670 | A1* | 2/2019 | Bei | G09G 3/20 |
| 2019/0064256 | A1* | 2/2019 | Wang | G01R 31/2843 |
| 2020/0211428 | A1* | 7/2020 | Wei | G09G 3/3225 |

FOREIGN PATENT DOCUMENTS

| | | | |
|---|---|---|---|
| CN | 106782248 | A | 5/2017 |
| CN | 108257541 | A | 7/2017 |
| CN | 107065313 | A | 8/2017 |
| CN | 107329298 | A | 11/2017 |

* cited by examiner

DRIVER CIRCUIT AND ITS WORKING METHOD AND DISPLAY DEVICE

CROSS-REFERENCE TO RELATED APPLICATION

This application claims priority to Chinese Patent Application No. 201910007225.2 filed on Jan. 4, 2019, which is incorporated herein by reference in its entirety.

TECHNICAL FIELD

The present disclosure relates to the field of display technologies, and in particular to a driver circuit and its working method and a display device.

BACKGROUND

With continuous development of display technologies, there are more and more types of display devices. In order to improve production yield of the display devices, the display devices may be tested for several times during the production process of the display devices. By taking an active-matrix organic light emitting diode (AMOLED) display device as an example, when manufacturing the AMOLED display device, after cutting an AMOLED motherboard to obtain several separate display substrates, the display substrate is generally subjected to a lighting test (i.e., an ET test) to determine performance of the display substrate. After it is determined that the display substrate is good, test signal lines for performing the lighting test in the display substrate are cut off from the display substrate, then the module bonding process is performed at the display substrate, and finally a driver chip bound on the display substrate drives the display substrate to realize display function.

However, for signal line leads which are connected with the test signal lines before the test signal lines for performing the lighting test are cut off from the display substrate and which remain on the display substrate after the test signal lines for performing the lighting test are cut off from the display substrate, ports of the signal line leads are barely leaked in the air after the test signal lines for performing the lighting test are cut off from the display substrate, resulting in corrosion and oxidation of the signal line leads. In this way, when the driver chip drives the display substrate for displaying, a short circuit is easily formed between an outputted line of the driver chip and the signal line leads or the ports, resulting in that the display substrate cannot display normally.

SUMMARY

According to a first aspect, one embodiment of the present disclosure provides a driver circuit applicable to a display substrate. The driver circuit includes: a driver chip coupled with a plurality of signal lines; a plurality of signal line leads that are corresponding to the plurality of signal lines in a one-to-one manner; and a plurality of short-circuit shielding circuits that are corresponding to the plurality of signal line leads in a one-to-one manner. Each of the plurality of short-circuit shielding circuits is coupled between corresponding one of the plurality of signal line leads and corresponding one of the plurality of signal lines, and is configured to turn on or off a connection between the corresponding one of the plurality of signal line leads and the corresponding one of the plurality of signal lines.

Optionally, the plurality of signal lines include first signal lines configured to transmit a positive voltage signal and second signal lines configured to transmit a negative voltage signal; each of the plurality of short-circuit shielding circuits includes one of a first diode and a second diode; an anode of the first diode is coupled with one signal line lead which is one of the plurality of signal line leads and which is coupled with the short-circuit shielding circuit including the first diode; and a cathode of the first diode is coupled with corresponding one of the first signal lines; a cathode of the second diode is coupled with one signal line lead which is one of the plurality of signal line leads and which is coupled with the short-circuit shielding circuit including the second diode; and an anode of the second diode is coupled with corresponding one of the second signal lines.

Optionally, each of the plurality of short-circuit shielding circuit is further coupled with a gate control terminal; each of the plurality of short-circuit shielding circuit is configured to, under control of the gate control terminal, turn on or off a connection between one of the plurality of signal line leads that is coupled with the each of the plurality of short-circuit shielding circuit and one of the plurality of signal lines that is coupled with the each of the plurality of short-circuit shielding circuit.

Optionally, the gate control terminal includes a first control terminal and a second control terminal; each of the plurality of short-circuit shielding circuit includes a first control sub-circuit and a second control sub-circuit; the first control sub-circuit is coupled with the first control terminal, a first node and the one of the plurality of signal lines that is coupled with the each of the plurality of short-circuit shielding circuit, respectively; the first control sub-circuit is configured to, under control of the first control terminal, turn on or off a connection between the first node and the one of the plurality of signal lines that is coupled with the each of the plurality of short-circuit shielding circuit; and the second control sub-circuit is coupled with the second control terminal, the first node and the one of the plurality of signal line leads that is coupled with the each of the plurality of short-circuit shielding circuit, respectively; the second control sub-circuit is configured to, under control of the second control terminal, turn on or off a connection between the first node and the one of the plurality of signal line leads that is coupled with the each of the plurality of short-circuit shielding circuit.

Optionally, the first control sub-circuit includes a first switching transistor; a gate of the first switching transistor is coupled with the first control terminal; a first electrode of the first switching transistor is coupled with the one of the plurality of signal lines that is coupled with the each of the plurality of short-circuit shielding circuit; and a second electrode of the first switching transistor is coupled with the first node; the second control sub-circuit includes a second switching transistor; a gate of the second switching transistor is coupled with the second control terminal; a first electrode of the second switching transistor is coupled with the first node; a second electrode of the second switching transistor is coupled with the one of the plurality of signal line leads that is coupled with the each of the plurality of short-circuit shielding circuit.

Optionally, the first control terminal is coupled with the second control terminal.

Optionally, the first control terminal is coupled with the second control terminal.

Optionally, the plurality of signal lines include one or more of a data line, a power line, and a gate drive signal line; the gate drive signal line is applied in a gate drive circuit of the display substrate; and the plurality of signal line leads include one or more of a data-line lead coupled with the data line, a power-line lead coupled with the power line and a gate-drive-signal-line lead coupled with the gate drive signal line.

According to a second aspect, one embodiment of the present disclosure provides a display device including the above driver circuit.

According to a third aspect, one embodiment of the present disclosure provides a driver-circuit working method, which is applied to the above driver circuit. The working method includes: in a lighting test period during which a display substrate is subjected to a lighting test, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits; in a module lighting period during which the driver chip drives the display substrate to realize display function, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits; and providing, by the driver chip, corresponding driving signals for the plurality of signal lines.

Optionally, the plurality of signal lines include first signal lines configured to transmit a positive voltage signal and second signal lines configured to transmit a negative voltage signal, and each of the plurality of short-circuit shielding circuits includes one of a first diode and a second diode; an anode of the first diode is coupled with one of the plurality of signal line leads that is coupled with the short-circuit shielding circuit including the first diode; and a cathode of the first diode is coupled with corresponding one of the first signal lines; a cathode of the second diode is coupled with one of the plurality of signal line leads that is coupled with the short-circuit shielding circuit including the second diode; and an anode of the second diode is coupled with corresponding one of the second signal lines. In the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes: in the lighting test period, turning on, by the first diode, a connection between the one of the plurality of signal line leads that is coupled with the short-circuit shielding circuit including the first diode and the corresponding one of the first signal lines; and turning on, by the second diode, a connection between the one of the plurality of signal line leads that is coupled with the short-circuit shielding circuit including the second diode and corresponding one of the second signal lines. In the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits; and providing, by the driver chip, corresponding driving signals for the plurality of signal lines, includes: in the module lighting period, turning off, by the first diode, the connection between the one of the plurality of signal line leads that is coupled with the short-circuit shielding circuit including the first diode and the corresponding one of the first signal lines; and turning off, by the second diode, the connection between the one of the plurality of signal line leads that is coupled with the short-circuit shielding circuit including the second diode and corresponding one of the second signal lines; and providing, by the driver chip, corresponding driving signals for the first signal lines and the second signal lines.

Optionally, each of the plurality of short-circuit shielding circuits is coupled with a gate control terminal. In the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes: in the lighting test period, under control of the gate control terminal, turning on, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits. In the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits, includes: in the module lighting period, under control of the control terminal, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits.

Optionally, the gate control terminal includes a first control terminal and a second control terminal; each of the plurality of short-circuit shielding circuit includes a first control sub-circuit and a second control sub-circuit; the first control sub-circuit is coupled with the first control terminal, a first node and the one of the plurality of signal lines that is coupled with the each of the plurality of short-circuit shielding circuit, respectively; and the second control sub-circuit is coupled with the second control terminal, the first node and the one of the plurality of signal line leads that is coupled with the each of the plurality of short-circuit shielding circuit, respectively. In the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes: in the lighting test period, turning on, by the first control sub-circuit under control of the first control terminal, a connection between the first node and the one of the plurality of signal lines that is coupled with the each of the plurality of short-circuit shielding circuit; and turning on, by the second control sub-circuit under control of the second control terminal, a connection between the first node and the one of the plurality of signal line leads that is coupled with the each of the plurality of short-circuit shielding circuit. In the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits, includes: in the module lighting period, turning off, by the first control sub-circuit under control of the first control terminal, the connection between the first node and the one of the plurality of signal lines that is coupled with the each of the plurality of short-circuit shielding circuit; and turning off, by the second control sub-circuit under control of the second control terminal, the connection between the first node and the one of the plurality of signal line leads that is coupled with the each of the plurality of short-circuit shielding circuit.

Optionally, the first control sub-circuit includes a first switching transistor and the second control sub-circuit includes a second switching transistor. In the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes: in the lighting test period, turning on the first switching transistor under control of the first control terminal, and then turning on the connection between the first node and the one of the plurality of signal lines that is coupled with the each of the plurality of short-circuit shielding circuit; and, turning on the second switching transistor under control of the second control terminal and then turning on the connection between the first node and the one of the plurality of signal line leads that is coupled with the each of the plurality of short-circuit shielding circuit. In the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits, includes: in the module lighting period, turning off the first switching transistor under control of the first control terminal, and then turning off the connection between the first node and the one of the plurality of signal lines that is coupled with the each of the plurality of short-circuit shielding circuit; and, turning off the second switching transistor under control of the second control terminal and then turning off the connection between the first node and the one of the plurality of signal line leads that is coupled with the each of the plurality of short-circuit shielding circuit.

BRIEF DESCRIPTION OF THE DRAWINGS

In order to illustrate technical solutions according to embodiments of the present disclosure more clearly, drawings to be used in the description of the embodiments will be described briefly hereinafter. Apparently, the drawings described hereinafter are only some embodiments of the present disclosure, and other drawings may be obtained by those skilled in the art according to those drawings without creative work.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain the other embodiments, which also fall within the scope of the present disclosure.

During the entire production process of display devices, there are mainly two lighting forms.

Figure 1:
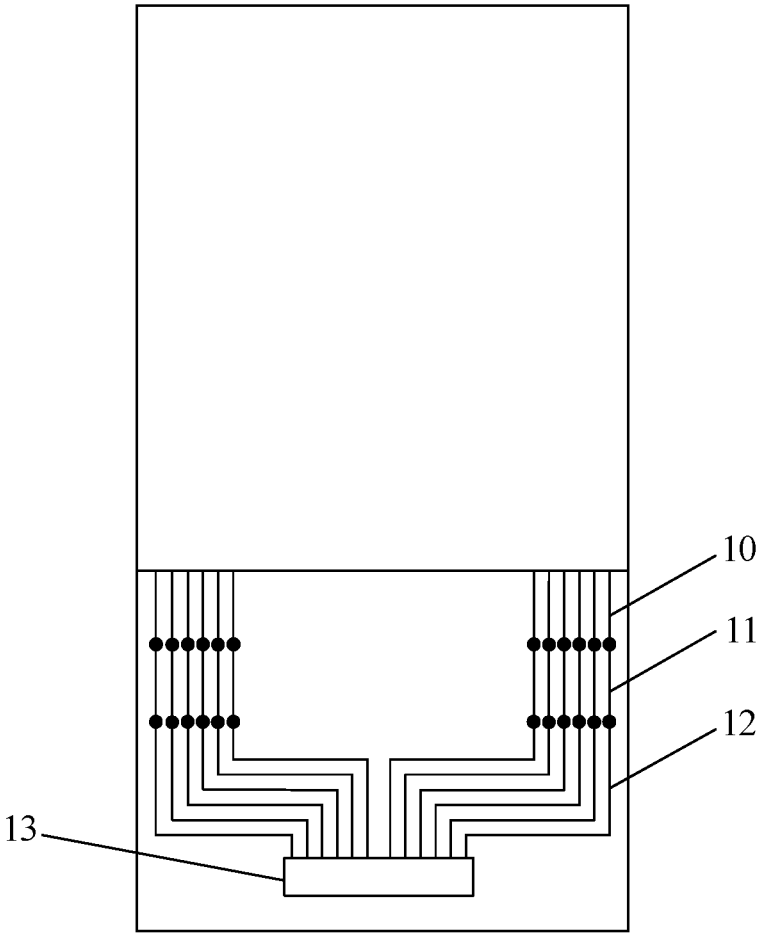
FIG. 1 is a schematic view of a display substrate in a lighting test period in the related art.
Figure 2:
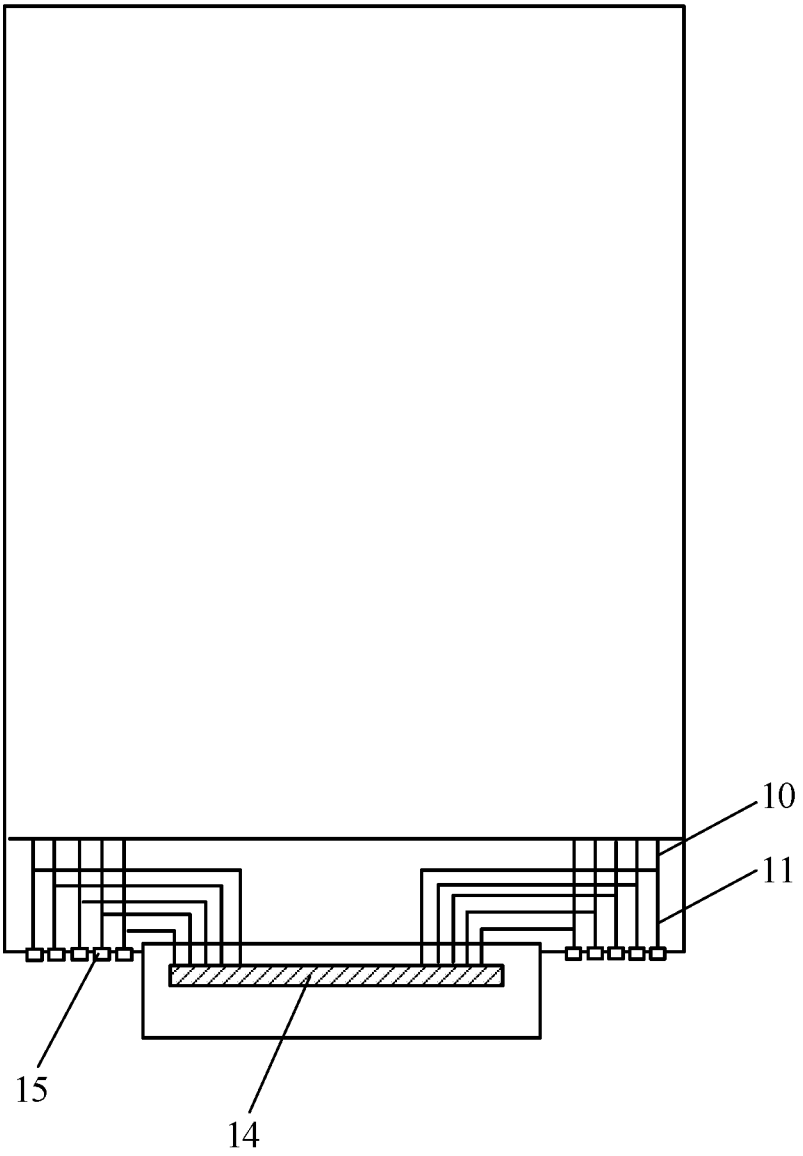
FIG. 2 is a schematic view of a display substrate in a module lighting period in the related art.

The first one is the lighting test. As shown in FIG. 1, in the lighting test, a signal line 10 of a display substrate is coupled with a test signal line 12 through a signal line lead 11. A test signal from a test module 13 is transmitted to the signal line lead 11 via the test signal line 12. Then the test signal is further transmitted to the signal line 10 via the signal line lead 11, thereby lighting the display substrate. After lighting the display substrate, the display substrate can be detected by some means in the related art to determine its performance. As shown in FIG. 2, after the lighting test is completed, both of the test signal line 12 and the test module 13 are cut off from the display substrate, then the module bonding process is performed at the display substrate. In the module bonding process, a driver chip 14 is bound on the display substrate. The driver chip 14 provides a driving signal for the signal line 10 of the display substrate.

The second one is final lighting period for the product after the module bonding process, which is also referred as a module lighting period. In the final lighting period, the driver chip 14 bound on the display substrate provides a driving signal for the signal line 10 of the display substrate through the signal line lead 11, thereby controlling the display substrate to realize display function.

In the related art, after the test signal line 12 for performing the lighting test in the display substrate is cut off from the display substrate, a punching port 15 of the signal line lead 11 remaining on the display substrate is barely leaked in the air, resulting in corrosion and oxidation of the signal line lead. In this way, when the driver chip 14 drives the display substrate for displaying, a short circuit is easily formed between an outputted line of the driver chip 14 and the signal line lead 11 or the punching port 15, resulting in that the display substrate cannot display normally.

In view of this, embodiments of the present application provide a driver circuit and its working method and a display device, which can solve the problems in the related art that after the test signal line for performing the lighting test in the display substrate is cut off from the display substrate, the signal line lead remaining on the display substrate results in that the display substrate cannot display normally.

Figure 3:
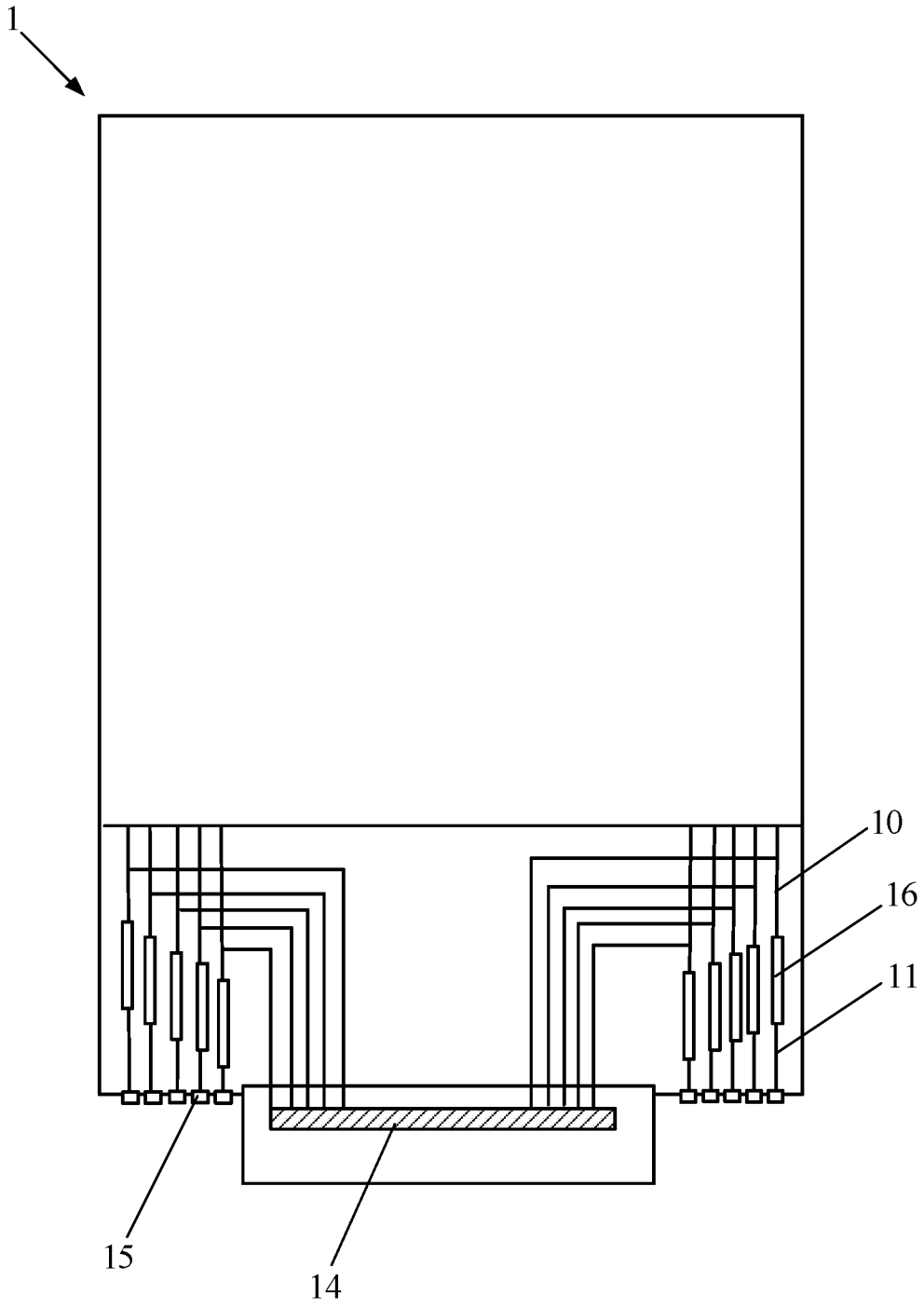
FIG. 3 is a first schematic view of a display substrate in a module lighting period according to an embodiment of the present disclosure.

Referring to FIG. 3, one embodiment of the present application provides a driver circuit which is applicable to a display substrate 1. The driver circuit includes a plurality of signal line leads 11 which are corresponding to signal lines 10 of the display substrate 1 in a one-to-one manner, a plurality of short-circuit shielding circuits 16 which are corresponding to the signal line leads 11 in a one-to-one manner, and a driver chip 14 which is coupled with the signal lines 10, respectively.

The short-circuit shielding circuit 16 is connected between the corresponding signal line lead 11 and the corresponding signal line 10. The short-circuit shielding circuits 16 is configured to, turn on connection between the corresponding signal line lead 11 and the corresponding signal line 10 in a lighting test period, and turn off the connection between the corresponding signal line lead 11 and the corresponding signal line 10 in a module lighting period.

The driver chip 14 is configured to provide corresponding driving signals for the signal lines 10 in the module lighting period.

Specifically, in the above driver circuit, one signal line lead 11 is coupled with the corresponding signal line 10 through the corresponding short-circuit shielding circuits 16, and then the short-circuit shielding circuits 16 control turning on or off of the connection between the corresponding signal line lead 11 and the corresponding signal line 10. When the short-circuit shielding circuit 16 controls turning on connection between the corresponding signal line lead 11 and the corresponding signal line 10, the test signal received by the signal line lead 11 can be transmitted to the corresponding signal line 10. When the short-circuit shielding circuits 16 controls turning off connection between the corresponding signal line lead 11 and the corresponding signal line 10, the signal line 10 does not receive the test signal but receives the driving signal provided by the driver chip 14 bound on the display substrate 1.

More specifically, lighting periods for the display substrate 1 includes a lighting test period and a module lighting period. When the above driver circuit is applied to the display substrate 1, the working process of the driver circuit includes: in the lighting test period, the short-circuit shielding circuit 16 controls turning on connection between the corresponding signal line lead 11 and the corresponding signal line 10, meanwhile, the signal line lead 11 is further coupled with a test signal line in a test area on the display substrate 1, the test signal line receives a test signal provided by a test module, and transmits the test signal to the signal line lead 11. Then the signal line lead 11 transmits the received test signal to the corresponding signal line 10 through the short-circuit shielding circuit 16, thereby lighting the display substrate 1. After lighting the display substrate, the display substrate 1 can be detected to determine its performance.

After the lighting test period, the test signal line in the test area of the display substrate 1 is cut off from the display substrate, and then the driver chip 14 is bound on the display substrate 1, thereby enabling the driver chip 14 to be coupled with several signal lines 10 of the display substrate 1, respectively. Then the driver chip 14 can provide the driving signal for the signal lines 10. In the module lighting period, the short-circuit shielding circuit 16 controls turning off connection between the corresponding signal line lead 11 and the corresponding signal line 10, and the driver chip 14 directly provides the driving signal for the signal lines 10, thereby controlling the display substrate 1 to realize display function.

As can be seen from the specific structure and working process of the above driver circuit, in the driver circuit provided in one embodiment of the present disclosure, the presence of the short-circuit shielding circuit 16 between the signal line 10 and the signal line lead 11 can control turning on connection between the corresponding signal line lead 11 and the corresponding signal line 10 in the lighting test period, thereby enabling the signal line lead 11 to transmit the test signal to the corresponding signal line 10 and then performing the lighting test in the display substrate.

The short-circuit shielding circuit 16 can further control turning off connection between the corresponding signal line lead 11 and the corresponding signal line 10 in the module lighting period, so that when the driver chip 14 provides the driving signal for the corresponding signal line 10, the driving signal can be accurately transmitted to the corresponding signal line 10 without being short-circuited by the signal line lead 11 corresponding to the signal line 10. Then, the display substrate 1 can be driven by the driver chip 14 to display normally. Therefore, the driver circuit provided in one embodiment of the present disclosure can solve the problems in the related art that the signal line lead easily causes the display substrate to display abnormally in the module lighting period, and then can greatly improve the yield of display substrate 1.

The short-circuit shielding circuit 16 provided by the above embodiment may be in a variety of forms. Several specific structures of the short-circuit shielding circuit 16 as well as their working process are described hereinafter.

Figure 4:
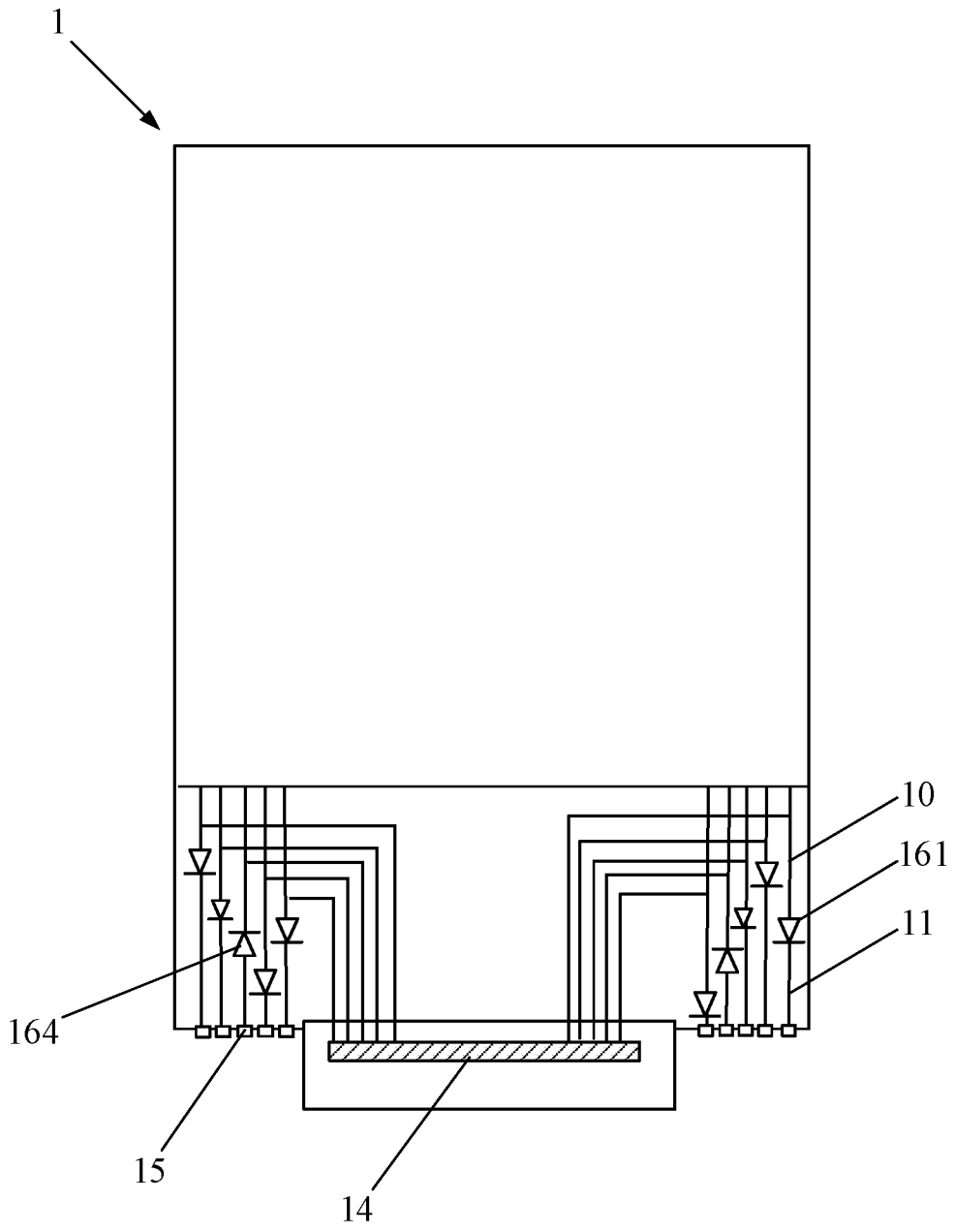
FIG. 4 is a second schematic view of a display substrate in a module lighting period according to an embodiment of the present disclosure.

A first structure of the short-circuit shielding circuit 16 is shown in FIG. 4. The short-circuit shielding circuit 16 includes a first diode 164 and a second diode 161. Specifically, the signal lines 10 include a first signal line configured to transmit a positive voltage signal and/or a second signal line configured to transmit a negative voltage signal. The first diode 164 is coupled between the corresponding first signal line and the corresponding signal line lead 11. An anode of the first diode 164 is coupled with the corresponding signal line lead 11, and a cathode of the first diode 164 is coupled with the corresponding first signal line. The second diode 161 is coupled between the corresponding second signal line and the corresponding signal line lead 11. An anode of the second diode 161 is coupled with the corresponding second signal line, and a cathode of the second diode 161 is coupled with the corresponding signal line lead 11.

More specifically, the signal lines 10 of the display substrate 1 mainly includes two types: one is the first signal line configured to transmit a positive voltage signal and the other one is a second signal line configured to transmit a negative voltage signal. The first diode 164 is coupled between the corresponding first signal line and the corresponding signal line lead 11. The anode of the first diode 164 is coupled with the corresponding signal line lead 11, and the cathode of the first diode 164 is coupled with the corresponding first signal line. The second diode 161 is coupled between the corresponding second signal line and the corresponding signal line lead 11. The anode of the second diode 161 is coupled with the corresponding second signal line, and the cathode of the second diode 161 is coupled with the corresponding signal line lead 11. In this way, in the lighting test period, the signal line leads 11 can transmit the received test signals to the corresponding first signal line and the corresponding second signal line through the first diode 164 and the second diode 161, thereby performing the lighting test for the display substrate 1.

In the module lighting period, potentials of punched ports of the signal line leads 11 are ground potentials since the punched ports of the signal line leads 11 are etched and oxidized after the punching process, so that the ground potential is applied to the anode of the first diode 164 and the ground potential is applied to the cathode of the second diode 161. Further, the first signal line is configured to transmit the positive voltage signal and the second signal line is configured to transmit the negative voltage signal. When the driver chip 14 drives the display substrate 1 for displaying, the driving signal provided by the driver chip 14 for the first signal line is the positive voltage signal and the driving signal provided by the driver chip 14 for the second signal line is the negative voltage signal, thus, the positive voltage signal is applied to the cathode of the first diode 164 and the negative voltage signal is applied to the anode of the second diode 161. In this way, in the module lighting period, both of the first diode 164 and the second diode 161 are in the cut-off state, so that electrical current can accurately flow from the driver chip 14 to the corresponding signal line 10, without flowing from the driver chip 14 to the punched ports 15 of the signal line leads 11, thereby avoiding occurrence of a short circuit between an outputted line of the driver chip 14 and the signal line leads 11 or the punched ports 15.

It should be noted that the above first diode 164 and the second diode 161 may be selected from various types such as organic light emitting diodes. Since the organic light emitting diode is small in size, application of the organic light emitting diodes in the short-circuit shielding circuit 16 is conducive to narrow borders of the display substrate 1.

Thus, when the short-circuit shielding circuit 16 of the above embodiment employs the first diode 164 and the second diode 161, it is realized that the test signal can be transmitted from the signal line lead 11 to the signal line 10 during the lighting test period and the driving signal provided by the driver chip 14 during the module lighting period can be transmitted only to the corresponding signal line 10 without being transmitted to the punched port 15 of the signal line lead 11. Therefore, when the short-circuit shielding circuit 16 is composed of the first diode 164 and the second diode 161, it not only can ensure that the display substrate 1 can perform the lighting test normally, but also can realize the normal display function of the display substrate 1 during the module lighting period.

According to a second structure of the short-circuit shielding circuit 16, the short-circuit shielding circuit 16 is coupled with a control terminal such as a gate control terminal, the corresponding signal line lead 11 and the corresponding signal line 10, respectively. The short-circuit shielding circuit 16 is configured to, under control of the control terminal, turn on connection between the corresponding signal line lead 11 and the corresponding signal line 10 in a lighting test period, and turn off the connection between the corresponding signal line lead 11 and the corresponding signal line 10 in a module lighting period.

Specifically, the short-circuit shielding circuit 16 is coupled with the control terminal, the corresponding signal line lead 11 and the corresponding signal line 10, respectively, and can turn on or off the connection between the corresponding signal line lead 11 and the corresponding signal line 10 under control of the control terminal. In this way, in the lighting test period, the control terminal controls the short-circuit shielding circuit 16 to turn on connection between the corresponding signal line lead 11 and the corresponding signal line 10; in the module lighting period, the control terminal controls the short-circuit shielding circuit 16 to turn off connection between the corresponding signal line lead 11 and the corresponding signal line 10. As a result, it is ensured that the test signal can be transmitted from the signal line lead 11 to the signal line 10 during the lighting test period and the driving signal provided by the driver chip 14 during the module lighting period can be transmitted only to the corresponding signal line 10 without being transmitted to the punched port 15 of the signal line lead 11. Therefore, the short-circuit shielding circuit 16 of the above structure not only can ensure that the display substrate 1 can perform the lighting test normally, but also can realize the normal display function of the display substrate 1 during the module lighting period.

In some embodiments, the above driver circuit may include one switching transistor. A gate of the switching transistor is coupled with the control terminal such as a gate control terminal. A first electrode of the switching transistor is coupled with the corresponding signal line 10. A second electrode of the switching transistor is coupled with the signal line lead 11. In the lighting test period, the control terminal controls the switching transistor to turn on, thereby turning on the connection between the corresponding signal line 10 and the corresponding signal line lead 11. In the module lighting period, the control terminal controls the switching transistor to turn off, thereby turning off the connection between the corresponding signal line 10 and the corresponding signal line lead 11.

Figure 5:
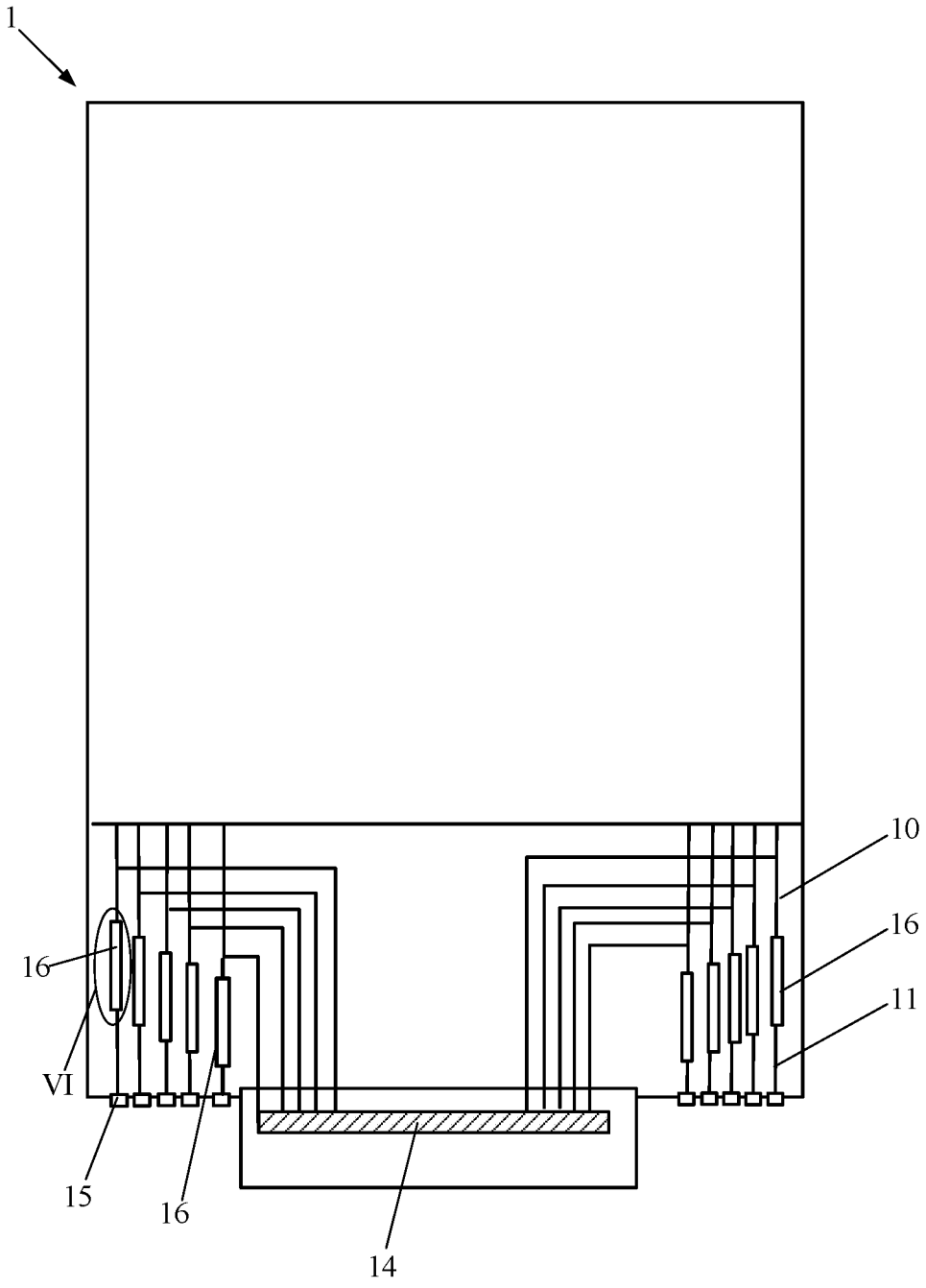
FIG. 5 is a third schematic view of a display substrate in a module lighting period according to an embodiment of the present disclosure.
Figure 6:
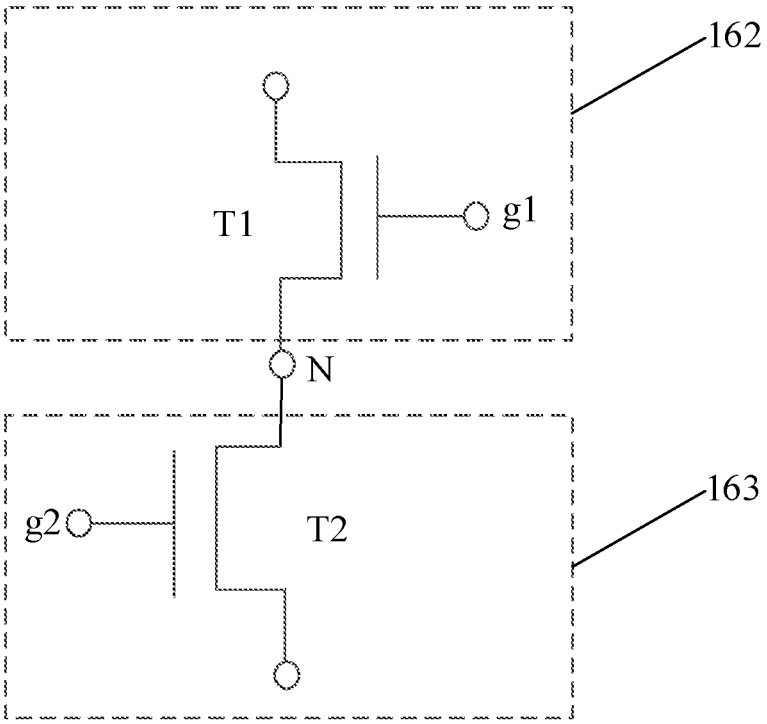
FIG. 6 is a schematic view of a short-circuit shielding circuit according to an embodiment of the present disclosure.

In some embodiments, as shown in FIG. 5 and FIG. 6, the above control terminal may include a first control terminal g1 and a second control terminal g2. The short-circuit shielding circuit 16 of the above second structure may specifically include a first control sub-circuit 162 and a second control sub-circuit 163.

The first control sub-circuit 162 is coupled with the first control terminal g1, a first node N and the corresponding signal line 10, respectively. The first control sub-circuit 162 is configured to, under control of the first control terminal g1, turn on a connection between the first node N and the corresponding signal line 10 in the lighting test period and turn off the connection between the first node N and the corresponding signal line 10 in the module lighting period.

The second control sub-circuit 163 is coupled with the second control terminal g2, the first node N and the corresponding signal line lead 11, respectively. The second control sub-circuit 163 is configured to, under control of the second control terminal g2, turn on a connection between the first node N and the corresponding signal line lead 11 in the lighting test period and turn off the connection between the first node N and the corresponding signal line lead 11 in the module lighting period.

Specifically, when the short-circuit shielding circuit 16 includes the above first control sub-circuit 162 and the above second control sub-circuit 163, in the lighting test period, the first control terminal g1 controls the first control sub-circuit 162 to turn on the connection between the first node N coupled with the first control sub-circuit 162 and the corresponding signal line 10, and the second control terminal g2 controls the second control sub-circuit 163 to turn on the connection between the first node N coupled with the second control sub-circuit 163 and the corresponding signal line lead 11. Then, the connection between the corresponding signal line 10 and the corresponding signal line lead 11 is turned on, and then the test signal can be transmitted from the corresponding signal line lead 11 to the corresponding signal line 10.

In the module lighting period, the first control terminal g1 controls the first control sub-circuit 162 to turn off the connection between the first node N coupled with the first control sub-circuit 162 and the corresponding signal line 10, and the second control terminal g2 controls the second control sub-circuit 163 to turn off the connection between the first node N coupled with the second control sub-circuit 163 and the corresponding signal line lead 11, thereby turning off the connection between the corresponding signal line 10 and the corresponding signal line lead 11. Then, the driving signal provided by the driver chip 14 may be directly transmitted to the signal line 10 without being transmitted to the punched ports of the signal line leads 11.

Therefore, when the short-circuit shielding circuit 16 of the second structure includes the above first control sub-circuit 162 and the above second control sub-circuit 163, in the lighting test period, the first control sub-circuit 162 and the second control sub-circuit 163 can properly turn on the connection between the corresponding signal line 10 and the corresponding signal line lead 11, thereby properly performing the lighting test for the display substrate 1; in the module lighting period, the first control sub-circuit 162 and the second control sub-circuit 163 can completely turn off the connection between the corresponding signal line 10 and the corresponding signal line lead 11, thereby properly ensuring that the driving signal provided by the driver chip 14 may be directly transmitted to the signal line 10 without being transmitted to the punched ports of the signal line leads 11.

It should be noted that the above first control terminal g1 and the second control terminal g2 may receive corresponding control signals, respectively, or the first control terminal g1 and the second control terminal g2 may be coupled with each other. When the first control terminal g1 and the second control terminal g2 are coupled with each other, the first control terminal g1 and the second control terminal g2 receive an identical control signal, thereby reducing an area occupied by traces formed on the display substrate 1, which is conducive to narrow borders of the display substrate 1.

Furthermore, the first control sub-circuit 162 provided in the above embodiment may include a first switching transistor T1. A gate of the first switching transistor T1 is coupled with the first control terminal g1. A first electrode of the first switching transistor T1 is coupled with the corresponding signal line 10. A second electrode of the first switching transistor T1 is coupled with the first node N. The second control sub-circuit 163 may include a second switching transistor T2. A gate of the second switching transistor T2 is coupled with the second control terminal g2. A first electrode of the second switching transistor T2 is coupled with the first node N. A second electrode of the second switching transistor T2 is coupled with the corresponding signal line lead 11.

Specifically, in the lighting test period, under control of the first control terminal g1, the first switching transistor T1 is turned on and then turns on the connection between the first node N and the corresponding signal line 10; under control of the second control terminal g2, the second switching transistor T2 is turned on and then turns on the connection between the first node N and the corresponding signal line lead 11. Then, the connection between the corresponding signal line 10 and the corresponding signal line lead 11 is turned on, and then the test signal can be transmitted from the corresponding signal line lead 11 to the corresponding signal line 10. In the module lighting period, under control of the first control terminal g1, the first switching transistor T1 is turned off and then turns off the connection between the first node N and the corresponding signal line 10; under control of the second control terminal g2, the second switching transistor T2 is turned off and then turns off the connection between the first node N and the corresponding signal line lead 11, thereby turning off the connection between the corresponding signal line 10 and the corresponding signal line lead 11. Then, the driving signal provided by the driver chip 14 may be directly transmitted to the signal line 10 without being transmitted to the punched ports 15 of the signal line leads 11.

It should be noted that the first switching transistor T1 and the second switching transistor T2 may be in a variety of types. For example, the first switching transistor T1 and the second switching transistor T2 may be P-type thin film transistors or N-type thin film transistors. When both of the first switching transistor T1 and the second switching transistor T2 are P-type thin film transistors, the condition of turning on the connection between the first switching transistor T1 and the second switching transistor T2 is $Vgs-Vth<0$, where Vgs represents a voltage difference between the gate and the source of the switching transistor, and Vth represents a threshold voltage of the switching transistor.

In the lighting test period, both of the first switching transistor T1 and the second switching transistor T2 are turned on, the test signal can be transmitted from the corresponding signal line lead 11 to the corresponding signal line 10. At this point, the first node N is used as the source of the first switching transistor T1, and also used as the drain of the second switching transistor T2; the first electrode of the first switching transistor T1 is used as the drain of the first switching transistor T1, and the second electrode of the second switching transistor T2 is used as the source of the second switching transistor T2.

In the module lighting period, in order to prevent the driving signal provided by the driver chip 14 from being transmitted to the signal line lead 11, both of the first switching transistor T1 and the second switching transistor T2 are turned off. At this point, the first node N is used as the drain of the first switching transistor T1, and also used as the source of the second switching transistor T2; the first electrode of the first switching transistor T1 is used as the source of the first switching transistor T1, and the second electrode of the second switching transistor T2 is used as the drain of the second switching transistor T2. The condition of turning off the first switching transistor T1 is $Vgs1=Vg1-V1>Vth1$, where Vgs1 represents a voltage difference between the gate and the source of the first switching transistor T1, Vg1 represents a gate voltage of the first switching transistor T1, Vg1 represents a voltage of the first electrode of the first switching transistor T1, and V1 represents a threshold voltage of the first switching transistor T1. The condition of turning off the second switching transistor T2 is $Vgs2=Vg2-V2>Vth2$, where Vgs2 represents a voltage difference between the gate and the source of the second switching transistor T2, Vg2 represents a gate voltage of the second switching transistor T2, and V2 represents a voltage of the first electrode of the second switching transistor T2.

It should be noted that the gate of the first switching transistor T1, the first electrode of the first switching transistor T1, the gate of the second switching transistor T2 and the first node N may be coupled with a control circuit through traces. The control circuit provides corresponding signals to the gate of the first switching transistor T1, the first electrode of the first switching transistor T1, the gate of the second switching transistor T2 and the first node N, thereby turning on both of the first switching transistor T1 and the second switching transistor T2 in the lighting test period and turning off both of the first switching transistor T1 and the second switching transistor T2 in the module lighting period.

The above signal line 10 and the signal line lead 11 may be selected from various types. For example, the above signal lines 10 may include one or more of a data line, a power line, and a gate drive signal line. The gate drive signal line is applied in a gate drive circuit of the display substrate 1. The above signal line leads 11 may include one or more of a data-line lead coupled with the data line, a power-line lead coupled with the power line and a gate-drive-signal-line lead coupled with the gate drive signal line.

Specifically, when the signal line 10 and the signal line lead 11 are of the above types, the test module 13 can provide corresponding test signals according to the types of the signal lines 10 and the signal line leads 11 in the lighting test period, and the driver chip 14 can provide corresponding driving signals according to the types of the signal lines 10 and the signal line leads 11 in the module lighting period.

One embodiment of the present disclosure further provides a display device which includes the above driver circuit.

In the driver circuit provided in above embodiment, the presence of the short-circuit shielding circuit 16 between the signal line 10 and the signal line lead 11 can enable the driver circuit to ensure that the display substrate 1 can perform the lighting test normally while avoiding the problems in the related art that the signal line lead easily causes the display substrate to display abnormally in the module lighting period. Thus, the display device of one embodiment of the present disclosure includes the above driver circuit and has the above beneficial effects accordingly.

One embodiment of the present disclosure further provides a working method of driver circuits, which may be applied to the above driver circuit. The working method includes:

turning on, by a short-circuit shielding circuit 16, connection between a corresponding signal line lead 11 and a corresponding signal line 10 in a lighting test period;

turning off, by the short-circuit shielding circuits 16, the connection between the corresponding signal line lead 11 and the corresponding signal line 10 in a module lighting period, and providing, by a driver chip 14, corresponding driving signals for signal lines 10.

Specifically, lighting periods for the display substrate 1 includes a lighting test period and a module lighting period. When the above driver circuit is applied to the display substrate 1, the working method of the driver circuit includes: in the lighting test period, the short-circuit shielding circuit 16 controls turning on connection between the corresponding signal line lead 11 and the corresponding signal line 10, meanwhile, the signal line lead 11 is further coupled with a test signal line in a test area on the display substrate 1, the test signal line receives a test signal provided by a test module, and transmits the test signal to the signal line lead 11. Then the signal line lead 11 transmits the received test signal to the corresponding signal line 10 through the short-circuit shielding circuit 16, thereby lighting the display substrate 1. After lighting the display substrate, the display substrate 1 can be detected to determine its performance.

After the lighting test period, the test signal line in the test area of the display substrate 1 is cut off from the display substrate, and then the driver chip 14 is bound on the display substrate 1, thereby enabling the driver chip 14 to be coupled with several signal lines 10 of the display substrate 1, respectively. Then the driver chip 14 can provide the driving signal for the signal lines 10. In the module lighting period, the short-circuit shielding circuit 16 controls turning off connection between the corresponding signal line lead 11 and the corresponding signal line 10, and the driver chip 14 directly provides the driving signal for the signal lines 10, thereby controlling the display substrate 1 to realize display function.

According to the working method of the driver circuits provided in one embodiment of the present disclosure, the short-circuit shielding circuit 16 can control turning on connection between the corresponding signal line lead 11 and the corresponding signal line 10 in the lighting test period, thereby enabling the signal line lead 11 to transmit the test signal to the corresponding signal line 10 and then performing the lighting test in the display substrate. The short-circuit shielding circuit 16 can further control turning off connection between the corresponding signal line lead 11 and the corresponding signal line 10 in the module lighting period, so that when the driver chip 14 provides the driving signal for the corresponding signal line 10, the driving signal can be accurately transmitted to the corresponding signal line 10 without being short-circuited by the signal line lead 11 corresponding to the signal line 10. Then, the display substrate 1 can be driven by the driver chip 14 to display normally. Therefore, the driver-circuit working method provided in one embodiment of the present disclosure can solve the problems in the related art that the signal line lead easily causes the display substrate to display abnormally in the module lighting period.

In some embodiments, when the signal lines 10 include a first signal line configured to transmit a positive voltage signal and/or a second signal line configured to transmit a negative voltage signal, and when the short-circuit shielding circuit 16 includes a first diode 164 and a second diode 161, the working method specifically includes:

in the lighting test period, turning on, by the first diode 164, connection between the corresponding signal line lead 11 and the corresponding signal line 10, and turning on, by the second diode 161, connection between the corresponding signal line lead 11 and the corresponding signal line 10;

in the module lighting period, turning off, by the first diode 164, connection between the corresponding signal line lead 11 and the corresponding signal line 10, and turning off, by the second diode 161, connection between the corresponding signal line lead 11 and the corresponding signal line 10; and providing, by the driver chip, corresponding driving signals for the first signal line and the second signal line.

Specifically, the signal lines 10 of the display substrate 1 mainly includes two types: one is the first signal line configured to transmit a positive voltage signal and the other one is a second signal line configured to transmit a negative voltage signal. The first diode 164 is coupled between the corresponding first signal line and the corresponding signal line lead 11. The anode of the first diode 164 is coupled with the corresponding signal line lead 11, and the cathode of the first diode 164 is coupled with the corresponding first signal line. The second diode 161 is coupled between the corresponding second signal line and the corresponding signal line lead 11. The anode of the second diode 161 is coupled with the corresponding second signal line, and the cathode of the second diode 161 is coupled with the corresponding signal line lead 11. In this way, in the lighting test period, the signal line leads 11 can transmit the received test signals to the corresponding first signal line and the corresponding second signal line through the first diode 164 and the second diode 161, thereby performing the lighting test for the display substrate 1.

In the module lighting period, potentials of punched ports of the signal line leads 11 are ground potentials since the punched ports of the signal line leads 11 are etched and oxidized after the punching process, so that the ground potential is applied to the anode of the first diode 164 and the ground potential is applied to the cathode of the second diode 161. Further, the first signal line is configured to transmit the positive voltage signal and the second signal line is configured to transmit the negative voltage signal. When the driver chip 14 drives the display substrate 1 for displaying, the driving signal provided by the driver chip 14 for the first signal line is the positive voltage signal and the driving signal provided by the driver chip 14 for the second signal line is the negative voltage signal, thus, the positive voltage signal is applied to the cathode of the first diode 164 and the negative voltage signal is applied to the anode of the second diode 161. In this way, in the module lighting period, both of the first diode 164 and the second diode 161 are in the cut-off state, so that electrical current can accurately flow from the driver chip 14 to the corresponding signal line 10, without flowing from the driver chip 14 to the punched ports 15 of the signal line leads 11, thereby avoiding occurrence of a short circuit between an outputted line of the driver chip 14 and the signal line leads 11 or the punched ports 15.

Thus, when the short-circuit shielding circuit 16 of the above embodiment employs the first diode 164 and the second diode 161, the driver-circuit working method provided in the above embodiment can realize that the test signal can be transmitted from the signal line lead 11 to the signal line 10 during the lighting test period and the driving signal provided by the driver chip 14 during the module lighting period can be transmitted only to the corresponding signal line 10 without being transmitted to the punched port 15 of the signal line lead 11. Therefore, when the short-circuit shielding circuit 16 is composed of the first diode 164 and the second diode 161, the driver-circuit working method provided in the above embodiment not only can ensure that the display substrate 1 can perform the lighting test normally, but also can realize the normal display function of the display substrate 1 during the module lighting period.

In some embodiments, when the short-circuit shielding circuit 16 is coupled with a control terminal, the corresponding signal line lead 11 and the corresponding signal line 10, respectively, the working method of the short-circuit shielding circuit 16 specifically includes:

in the lighting test period, under control of the control terminal, turning on, by the short-circuit shielding circuit 16, connection between the corresponding signal line lead 11 and the corresponding signal line 10;

in the module lighting period, under control of the control terminal, turning off, by the short-circuit shielding circuit 16, connection between the corresponding signal line lead 11 and the corresponding signal line 10.

Specifically, the short-circuit shielding circuit 16 is coupled with the control terminal, the corresponding signal line lead 11 and the corresponding signal line 10, respectively, and can turn on or off the connection between the corresponding signal line lead 11 and the corresponding signal line 10 under control of the control terminal. In this way, in the lighting test period, the control terminal controls the short-circuit shielding circuit 16 to turn on connection between the corresponding signal line lead 11 and the corresponding signal line 10; in the module lighting period, the control terminal controls the short-circuit shielding circuit 16 to turn off connection between the corresponding signal line lead 11 and the corresponding signal line 10. As a result, it is ensured that the test signal can be transmitted from the signal line lead 11 to the signal line 10 during the lighting test period and the driving signal provided by the driver chip 14 during the module lighting period can be transmitted only to the corresponding signal line 10 without being transmitted to the punched port 15 of the signal line lead 11. Therefore, the short-circuit shielding circuit 16 of the above structure not only can ensure that the display substrate 1 can perform the lighting test normally, but also can realize the normal display function of the display substrate 1 during the module lighting period.

Further, when the control terminal includes a first control terminal g1 and a second control terminal g2, and when the short-circuit shielding circuit 16 includes a first control sub-circuit 162 and a second control sub-circuit 163, the working method of the short-circuit shielding circuit 16 specifically includes:

in the lighting test period, turning on, by the first control sub-circuit 162 under control of the first control terminal g1, a connection between the first node N and the corresponding signal line 10, and turning on, by the second control sub-circuit 163 under control of the second control terminal g2, a connection between the first node N and the corresponding signal line lead 11;

in the module lighting period, turning off, by the first control sub-circuit 162 under control of the first control terminal g1, the connection between the first node N and the corresponding signal line 10, and turning off, by the second control sub-circuit 163 under control of the second control terminal g2, the connection between the first node N and the corresponding signal line lead 11.

Specifically, when the short-circuit shielding circuit 16 includes the above first control sub-circuit 162 and the above second control sub-circuit 163, in the lighting test period, the first control terminal g1 controls the first control sub-circuit 162 to turn on the connection between the first node N coupled with the first control sub-circuit 162 and the corresponding signal line 10, and the second control terminal g2 controls the second control sub-circuit 163 to turn on the connection between the first node N coupled with the second control sub-circuit 163 and the corresponding signal line lead 11. Then, the connection between the corresponding signal line 10 and the corresponding signal line lead 11 is turned on, and then the test signal can be transmitted from the corresponding signal line lead 11 to the corresponding signal line 10.

In the module lighting period, the first control terminal g1 controls the first control sub-circuit 162 to turn off the connection between the first node N coupled with the first control sub-circuit 162 and the corresponding signal line 10, and the second control terminal g2 controls the second control sub-circuit 163 to turn off the connection between the first node N coupled with the second control sub-circuit 163 and the corresponding signal line lead 11, thereby turning off the connection between the corresponding signal line 10 and the corresponding signal line lead 11. Then, the driving signal provided by the driver chip 14 may be directly transmitted to the signal line 10 without being transmitted to the punched ports of the signal line leads 11.

Therefore, when the short-circuit shielding circuit 16 of the second structure includes the above first control sub-circuit 162 and the above second control sub-circuit 163, according to the driver-circuit working method provided in the above embodiment, in the lighting test period, the first control sub-circuit 162 and the second control sub-circuit 163 can properly turn on the connection between the corresponding signal line 10 and the corresponding signal line lead 11, thereby properly performing the lighting test for the display substrate 1; in the module lighting period, the first control sub-circuit 162 and the second control sub-circuit 163 can completely turn off the connection between the corresponding signal line 10 and the corresponding signal line lead 11, thereby properly ensuring that the driving signal provided by the driver chip 14 may be directly transmitted to the signal line 10 without being transmitted to the punched ports of the signal line leads 11.

Further, when the first control sub-circuit 162 includes a first switching transistor T1 and the second control sub-circuit 163 includes a second switching transistor T2, the working process of the first control sub-circuit 162 and the second control sub-circuit 163 includes:

in the lighting test period, turning on the first switching transistor T1 under control of the first control terminal g1, and then turning on the connection between the first node N and the corresponding signal line 10; and, turning on the second switching transistor T2 under control of the second control terminal g2 and then turning on the connection between the first node N and the corresponding signal line lead 11;

in the module lighting period, turning off the first switching transistor T1 under control of the first control terminal g1, and then turning off the connection between the first node N and the corresponding signal line 10; and, turning off the second switching transistor T2 under control of the second control terminal g2 and then turning off the connection between the first node N and the corresponding signal line lead 11.

Specifically, in the lighting test period, under control of the first control terminal g1, the first switching transistor T1 is turned on and then turns on the connection between the first node N and the corresponding signal line 10; under control of the second control terminal g2, the second switching transistor T2 is turned on and then turns on the connection between the first node N and the corresponding signal line lead 11. Then, the connection between the corresponding signal line 10 and the corresponding signal line lead 11 is turned on, and then the test signal can be transmitted from the corresponding signal line lead 11 to the corresponding signal line 10. In the module lighting period, under control of the first control terminal g1, the first switching transistor T1 is turned off and then turns off the connection between the first node N and the corresponding signal line 10; under control of the second control terminal g2, the second switching transistor T2 is turned off and then turns off the connection between the first node N and the corresponding signal line lead 11, thereby turning off the connection between the corresponding signal line 10 and the corresponding signal line lead 11. Then, the driving signal provided by the driver chip 14 may be directly transmitted to the signal line 10 without being transmitted to the punched ports 15 of the signal line leads 11.

It should be noted that the first switching transistor T1 and the second switching transistor T2 may be in a variety of types. For example, the first switching transistor T1 and the second switching transistor T2 may be P-type thin film transistors or N-type thin film transistors. When both of the first switching transistor T1 and the second switching transistor T2 are P-type thin film transistors, in the module lighting period, in order to prevent the driving signal provided by the driver chip 14 from being transmitted to the signal line lead 11, both of the first switching transistor T1 and the second switching transistor T2 are turned off. At this point, the first node N is used as the drain of the first switching transistor T1, and also used as the source of the second switching transistor T2; the first electrode of the first switching transistor T1 is used as the source of the first switching transistor T1, and the second electrode of the second switching transistor T2 is used as the drain of the second switching transistor T2. The condition of turning off the first switching transistor T1 is $Vgs1=Vg1-V1>Vth1$, where Vgs1 represents a voltage difference between the gate and the source of the first switching transistor T1, Vg1 represents a gate voltage of the first switching transistor T1, Vg1 represents a voltage of the first electrode of the first switching transistor T1, and V1 represents a threshold voltage of the first switching transistor T1. The condition of turning off the second switching transistor T2 is $Vgs2=Vg2-V2>Vth2$, where Vgs2 represents a voltage difference between the gate and the source of the second switching transistor T2, Vg2 represents a gate voltage of the second switching transistor T2, and V2 represents a voltage of the first electrode of the second switching transistor T2.

It should be noted that the gate of the first switching transistor T1, the first electrode of the first switching transistor T1, the gate of the second switching transistor T2 and the first node N may be coupled with a control circuit through traces. The control circuit provides corresponding signals to the gate of the first switching transistor T1, the first electrode of the first switching transistor T1, the gate of the second switching transistor T2 and the first node N, thereby turning on both of the first switching transistor T1 and the second switching transistor T2 in the lighting test period and turning off both of the first switching transistor T1 and the second switching transistor T2 in the module lighting period.

Unless otherwise defined, any technical or scientific terms used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than being limited to physical or mechanical connection. Such words as "on/above", "under/below", "left" and "right" are merely used to represent relative position relationship, and when an absolute position of an object is changed, the relative position relationship will be changed too.

The above are merely the optional embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure.

What is claimed is:

1. A driver circuit applicable to a display substrate, comprising:

a driver chip coupled with a plurality of signal lines;

a plurality of signal line leads corresponding to the plurality of signal lines in a one-to-one manner; and a plurality of short-circuit shielding circuits corresponding to the plurality of signal line leads in a one-to-one manner;

wherein each of the plurality of short-circuit shielding circuits is coupled between corresponding one of the plurality of signal line leads and corresponding one of the plurality of signal lines, and is configured to turn on or off a connection between the corresponding one of the plurality of signal line leads and the corresponding one of the plurality of signal lines, wherein the plurality of signal lines include first signal lines configured to transmit a positive voltage signal and second signal lines configured to transmit a negative voltage signal;

each of the plurality of short-circuit shielding circuits includes one of a first diode and a second diode;

an anode of the first diode is coupled with one signal line lead which is one of the plurality of signal line leads and which is coupled with the short-circuit shielding circuit including the first diode; and a cathode of the first diode is coupled with corresponding one of the first signal lines;

a cathode of the second diode is coupled with one signal line lead which is one of the plurality of signal line leads and which is coupled with the short-circuit shielding circuit including the second diode; and an anode of the second diode is coupled with corresponding one of the second signal lines.

2. The driver circuit of claim 1, wherein each of the plurality of short-circuit shielding circuit is further coupled with a gate control terminal;

each of the plurality of short-circuit shielding circuit is configured to, under control of the gate control terminal, turn on or off a connection between one of the plurality of signal line leads that is coupled with the each of the plurality of short-circuit shielding circuit and one of the plurality of signal lines that is coupled with the each of the plurality of short-circuit shielding circuit.

3. The driver circuit of claim 2, wherein the gate control terminal includes a first control terminal and a second control terminal;

each of the plurality of short-circuit shielding circuit includes a first control sub-circuit and a second control sub-circuit;

the first control sub-circuit is coupled with the first control terminal, a first node and the one of the plurality of signal lines that is coupled with the each of the plurality of short-circuit shielding circuit, respectively; the first control sub-circuit is configured to, under control of the first control terminal, turn on or off a connection between the first node and the one of the plurality of signal lines that is coupled with the each of the plurality of short-circuit shielding circuit; and the second control sub-circuit is coupled with the second control terminal, the first node and the one of the plurality of signal line leads that is coupled with the each of the plurality of short-circuit shielding circuit, respectively; the second control sub-circuit is configured to, under control of the second control terminal, turn on or off a connection between the first node and the one of the plurality of signal line leads that is coupled with the each of the plurality of short-circuit shielding circuit.

4. The driver circuit of claim 3, wherein the first control sub-circuit includes a first switching transistor; a gate of the first switching transistor is coupled with the first control terminal; a first electrode of the first switching transistor is coupled with the one of the plurality of signal lines that is coupled with the each of the plurality of short-circuit shielding circuit; and a second electrode of the first switching transistor is coupled with the first node;

the second control sub-circuit includes a second switching transistor; a gate of the second switching transistor is coupled with the second control terminal; a first electrode of the second switching transistor is coupled with the first node; a second electrode of the second switching transistor is coupled with the one of the plurality of signal line leads that is coupled with the each of the plurality of short-circuit shielding circuit.

5. The driver circuit of claim 4, wherein the first control terminal is coupled with the second control terminal.

6. The driver circuit of claim 3, wherein the first control terminal is coupled with the second control terminal.

7. The driver circuit of claim 1, wherein the plurality of signal lines include one or more of a data line, a power line, and a gate drive signal line; the gate drive signal line is applied in a gate drive circuit of the display substrate; and the plurality of signal line leads include one or more of a data-line lead coupled with the data line, a power-line lead coupled with the power line and a gate-drive-signal-line lead coupled with the gate drive signal line.

8. A display device comprising the driver circuit of claim 1.

9. A driver-circuit working method, which is applied to the driver circuit of claim 1, the working method comprising:

in a lighting test period during which a display substrate is subjected to a lighting test, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits;

in a module lighting period during which the driver chip drives the display substrate to realize display function, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits; and providing, by the driver chip, corresponding driving signals for the plurality of signal lines.

10. The working method of claim 9, wherein the plurality of signal lines include first signal lines configured to transmit a positive voltage signal and second signal lines configured to transmit a negative voltage signal, and each of the plurality of short-circuit shielding circuits includes one of a first diode and a second diode; an anode of the first diode is coupled with one of the plurality of signal line leads that is coupled with the short-circuit shielding circuit including the first diode; and a cathode of the first diode is coupled with corresponding one of the first signal lines; a cathode of the second diode is coupled with one of the plurality of signal line leads that is coupled with the short-circuit shielding circuit including the second diode; and an anode of the second diode is coupled with corresponding one of the second signal lines;

in the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes:

in the lighting test period, turning on, by the first diode, a connection between the one of the plurality of signal line leads that is coupled with the short-circuit shielding circuit including the first diode and the corresponding one of the first signal lines; and turning on, by the second diode, a connection between the one of the plurality of signal line leads that is coupled with the short-circuit shielding circuit including the second diode and corresponding one of the second signal lines;

in the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits; and providing, by the driver chip, corresponding driving signals for the plurality of signal lines, includes:

in the module lighting period, turning off, by the first diode, the connection between the one of the plurality of signal line leads that is coupled with the short-circuit shielding circuit including the first diode and the corresponding one of the first signal lines; and turning off, by the second diode, the connection between the one of the plurality of signal line leads that is coupled with the short-circuit shielding circuit including the second diode and corresponding one of the second signal lines; and providing, by the driver chip, corresponding driving signals for the first signal lines and the second signal lines.

11. The working method of claim 9, wherein each of the plurality of short-circuit shielding circuits is coupled with a gate control terminal;

in the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes:

in the lighting test period, under control of the gate control terminal, turning on, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits;

in the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits, includes:

in the module lighting period, under control of the control terminal, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits.

12. The working method of claim 11, wherein the gate control terminal includes a first control terminal and a second control terminal; each of the plurality of short-circuit shielding circuit includes a first control sub-circuit and a second control sub-circuit; the first control sub-circuit is coupled with the first control terminal, a first node and the one of the plurality of signal lines that is coupled with the each of the plurality of short-circuit shielding circuit, respectively; and the second control sub-circuit is coupled with the second control terminal, the first node and the one of the plurality of signal line leads that is coupled with the each of the plurality of short-circuit shielding circuit, respectively;

in the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes:

in the lighting test period, turning on, by the first control sub-circuit under control of the first control terminal, a connection between the first node and the one of the plurality of signal lines that is coupled with the each of the plurality of short-circuit shielding circuit; and turning on, by the second control sub-circuit under control of the second control terminal, a connection between the first node and the one of the plurality of signal line leads that is coupled with the each of the plurality of short-circuit shielding circuit;

in the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits, includes:

in the module lighting period, turning off, by the first control sub-circuit under control of the first control terminal, the connection between the first node and the one of the plurality of signal lines that is coupled with the each of the plurality of short-circuit shielding circuit; and turning off, by the second control sub-circuit under control of the second control terminal, the connection between the first node and the one of the plurality of signal line leads that is coupled with the each of the plurality of short-circuit shielding circuit.

13. The working method of claim 12, wherein the first control sub-circuit includes a first switching transistor and the second control sub-circuit includes a second switching transistor;

in the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes:

in the lighting test period, turning on the first switching transistor under control of the first control terminal, and then turning on the connection between the first node and the one of the plurality of signal lines that is coupled with the each of the plurality of short-circuit shielding circuit; and, turning on the second switching transistor under control of the second control terminal and then turning on the connection between the first node and the one of the plurality of signal line leads that is coupled with the each of the plurality of short-circuit shielding circuit;

in the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits, includes:

in the module lighting period, turning off the first switching transistor under control of the first control terminal, and then turning off the connection between the first node and the one of the plurality of signal lines that is coupled with the each of the plurality of short-circuit shielding circuit; and, turning off the second switching transistor under control of the second control terminal and then turning off the connection between the first node and the one of the plurality of signal line leads that is coupled with the each of the plurality of short-circuit shielding circuit.

14. A driver circuit applicable to a display substrate, comprising:

a driver chip coupled with a plurality of signal lines;

a plurality of signal line leads corresponding to the plurality of signal lines in a one-to-one manner; and a plurality of short-circuit shielding circuits corresponding to the plurality of signal line leads in a one-to-one manner;

wherein each of the plurality of short-circuit shielding circuits is coupled between corresponding one of the plurality of signal line leads and corresponding one of the plurality of signal lines, and is configured to turn on or off a connection between the corresponding one of the plurality of signal line leads and the corresponding one of the plurality of signal lines, wherein each of the plurality of short-circuit shielding circuit is further coupled with a gate control terminal;

each of the plurality of short-circuit shielding circuit is configured to, under control of the gate control terminal, turn on or off a connection between one of the plurality of signal line leads that is coupled with the each of the plurality of short-circuit shielding circuit and one of the plurality of signal lines that is coupled with the each of the plurality of short-circuit shielding circuit, wherein the gate control terminal includes a first control terminal and a second control terminal;

each of the plurality of short-circuit shielding circuit includes a first control sub-circuit and a second control sub-circuit;

the first control sub-circuit is coupled with the first control terminal, a first node and the one of the plurality of signal lines that is coupled with the each of the plurality of short-circuit shielding circuit, respectively; the first control sub-circuit is configured to, under control of the first control terminal, turn on or off a connection between the first node and the one of the plurality of signal lines that is coupled with the each of the plurality of short-circuit shielding circuit; and the second control sub-circuit is coupled with the second control terminal, the first node and the one of the plurality of signal line leads that is coupled with the each of the plurality of short-circuit shielding circuit, respectively; the second control sub-circuit is configured to, under control of the second control terminal, turn on or off a connection between the first node and the one of the plurality of signal line leads that is coupled with the each of the plurality of short-circuit shielding circuit.

15. A driver-circuit working method, which is applied to a driver circuit applicable to a display substrate, the driver circuit comprising:

a driver chip coupled with a plurality of signal lines;

a plurality of signal line leads corresponding to the plurality of signal lines in a one-to-one manner; and a plurality of short-circuit shielding circuits corresponding to the plurality of signal line leads in a one-to-one manner;

wherein each of the plurality of short-circuit shielding circuits is coupled between corresponding one of the plurality of signal line leads and corresponding one of the plurality of signal lines, and is configured to turn on or off a connection between the corresponding one of the plurality of signal line leads and the corresponding one of the plurality of signal lines, the working method comprising:

in a lighting test period during which the display substrate is subjected to a lighting test, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits;

in a module lighting period during which the driver chip drives the display substrate to realize display function, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits; and providing, by the driver chip, corresponding driving signals for the plurality of signal lines;

wherein the plurality of signal lines include first signal lines configured to transmit a positive voltage signal and second signal lines configured to transmit a negative voltage signal, and each of the plurality of short-circuit shielding circuits includes one of a first diode and a second diode; an anode of the first diode is coupled with one of the plurality of signal line leads that is coupled with the short-circuit shielding circuit including the first diode; and a cathode of the first diode is coupled with corresponding one of the first signal lines; a cathode of the second diode is coupled with one of the plurality of signal line leads that is coupled with the short-circuit shielding circuit including the second diode; and an anode of the second diode is coupled with corresponding one of the second signal lines;

in the lighting test period, turning on, by each of the plurality of short-circuit shielding circuits, a connection between one of the plurality of signal line leads that is coupled with the each of the plurality of short-circuit shielding circuits and one of the plurality of signal lines that is coupled with the each of the plurality of short-circuit shielding circuits, includes:

in the lighting test period, turning on, by the first diode, a connection between the one of the plurality of signal line leads that is coupled with the short-circuit shielding circuit including the first diode and the corresponding one of the first signal lines; and turning on, by the second diode, a connection between the one of the plurality of signal line leads that is coupled with the short-circuit shielding circuit including the second diode and corresponding one of the second signal lines;

in the module lighting period, turning off, by each of the plurality of short-circuit shielding circuits, the connection between the one of the plurality of signal line leads that is coupled with the each of the plurality of short-circuit shielding circuits and the one of the plurality of signal lines that is coupled with the each of the plurality of short-circuit shielding circuits; and providing, by the driver chip, corresponding driving signals for the plurality of signal lines, includes:

in the module lighting period, turning off, by the first diode, the connection between the one of the plurality of signal line leads that is coupled with the short-circuit shielding circuit including the first diode and the corresponding one of the first signal lines; and turning off, by the second diode, the connection between the one of the plurality of signal line leads that is coupled with the short-circuit shielding circuit including the second diode and corresponding one of the second signal lines; and providing, by the driver chip, corresponding driving signals for the first signal lines and the second signal lines.

* * * * *